US006540176B2

(12) United States Patent
Davis et al.

(10) Patent No.: US 6,540,176 B2
(45) Date of Patent: Apr. 1, 2003

(54) FIN DISENGAGEMENT DEVICE FOR LIMITING PROJECTILE RANGE

(75) Inventors: Bradford S. Davis, Jarrettsville; James M. Garner, Aberdeen; Jerry L. Watson, Darlington, all of MD (US); James F. Newill, Landenberg, PA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/756,003

(22) Filed: Jan. 8, 2001

(65) Prior Publication Data

US 2002/0088897 A1 Jul. 11, 2002

(51) Int. Cl.[7] ..... F42B 10/00

(52) U.S. Cl. ..... 244/3.24; 244/3.22; 244/3.23; 244/3.25; 102/347; 102/363

(58) Field of Search ..... 244/3.22, 3.23, 244/3.24, 3.25

(56) References Cited

U.S. PATENT DOCUMENTS 2,597,703 A * 5/1952 Busacker ..... 244/3.25
3,152,545 A * 10/1964 Potts Jr. ..... 102/387
3,430,900 A * 3/1969 Turner et al. ..... 244/3.23
3,580,179 A * 5/1971 Gawlick et al. ..... 102/92.7
3,891,162 A * 6/1975 Wolterman ..... 244/3.25
4,140,061 A * 2/1979 Campoli ..... 102/92.7
4,145,017 A * 3/1979 Stiklorus ..... 244/3.25
4,215,632 A * 8/1980 Sie ..... 102/92.7
4,362,107 A * 12/1982 Romer et al. ..... 102/520
4,553,482 A * 11/1985 Weber et al. ..... 102/529
4,724,765 A * 2/1988 Evrard et al. ..... 102/248

* cited by examiner

*Primary Examiner*—Charles T. Jordan
*Assistant Examiner*—Stephen A Holzen
(74) *Attorney, Agent, or Firm*—Paul S. Clohan, Jr.; William W. Randolph

(57) ABSTRACT

A fin disengagement device for limiting the range of a projectile uses an electronic safe and arm circuit to sense launch and spin levels. Once armed, the stored energy from the electronic safe and arm circuit is dumped into an initiator or directly to explosive bolts. The initiator ignites an energetic material to separate the fin from the projectile in-flight at a predetermined time. Alternatively, the explosive bolts separate the fin from the projectile in-flight at a predetermined time. In the embodiments using an initiator and energetic material, an opening or cavity in the rear portion of the projectile body or rod adapter acts as a pressure chamber. When enough pressure has built up from the burning of the energetic material, the front hub of the fin section expands enough to disengage the threads and separates the fin section from the projectile body.

6 Claims, 3 Drawing Sheets

FIN DISENGAGEMENT DEVICE FOR LIMITING PROJECTILE RANGE

STATEMENT OF GOVERNMENT INTEREST

The invention described herein may be manufactured and used by or for the Government of the United States of America for government purposes without the payment of any royalties therefor.

BACKGROUND OF THE INVENTION

The present invention relates in general to devices for limiting the range of projectiles and, in particular, to a fin disengagement device for limiting the range of a projectile.

Most prior devices for limiting the range of projectiles create high drag bodies by changing the shape of the nose section of the projectile. Other devices break up or separate the projectile for the purpose of creating damage to the desired target.

U.S. Pat. No. 3,580,179 discloses ammunition for target practice or other short-range purposes. The projectile's nose either disintegrates and/or is jettisoned off to create drag thereby altering the projectile's aerodynamic coefficients and ultimately decreasing its range.

U.S. Pat. No. 4,140,061 describes a short-range discarding-sabot training practice round and self-destruct subprojectile. A disintegrating nose cone is used to induce instability to the projectile.

U.S. Pat. No. 4,215,632 shows an exercise projectile, especially of the discarding sabot type. This invention harnesses the gun gas pressure and uses it to separate the projectile parts in-flight.

U.S. Pat. No. 4,362,107 discloses a practice projectile that breaks apart on impact.

U.S. Pat. No. 4,553,482 describes a practice projectile that uses the tracer to start a pyrotechnic delay to separate projectile parts.

U.S. Pat. No. 4,724,765 shows a projectile comprising a pyrotechnic charge. The projectile uses a pyrotechnic delay that is started on launch by the gun gases to ignite a charge located in the middle of the projectile's body.

No previous inventions were found that disengage just the fin section to destabilize the projectile. Most prior inventions alter the projectile's flight characteristics by making changes to the projectile's nose or by breaking up the projectile's body. The present invention does not create shrapnel when disengaged since the fin discard charge is designed to separate the fin section intact from the projectile's rod body. It has been proven by simulation and experimentation that jettisoning off the projectile's fin decreases its range much more dramatically than by blunting the projectile's nose.

SUMMARY OF THE INVENTION

The present invention includes a device that can be integrated into any fin-stabilized or flare-stabilized projectile for the purpose of separating the projectile's fin or flare section from the projectile's body.

During the initial portion of the flight, the trajectory of the projectile with the fin disengagement device installed will be closely matched to the tactical projectile that it resembles. At a predetermined time along the trajectory, the safe and arm electronic system initiates an energetic material to separate the fin from the rod. Once the fin is discarded, the projectile rod becomes aerodynamically unstable and tumbles, thus limiting its range.

One application of the invention is to create a range-limited training practice projectile that can be made similar in mass, external shape, and aerodynamic properties to the tactical kinetic energy projectile that it replicates. The practice projectile may be constructed to look like a sub-caliber fin-stabilized tank projectile and may be made of steel. The invention can also take the form of a replacement kit that is used to limit the range of existing projectiles.

The invention uses an electronic arming circuit, for example, the electronic arming circuit disclosed in copending U.S. patent application Ser. No. 09/707,289 entitled "An Electronic Arming Apparatus for Initiating Propellants and Explosives," having as inventors B. Davis, E. Bukowski, and W. D'Amico, which is hereby expressly incorporated by reference.

Further objects, features and advantages of the invention will become apparent from the following detailed description taken in conjunction with the following drawing.

BRIEF DESCRIPTION OF THE DRAWINGS

Throughout the Figures, reference numerals that are the same refer to the same features.

DETAILED DESCRIPTION OF THE PREFERRED EMBODIMENTS

In one embodiment, the invention includes six components; a fin, a safe and arm electronics circuit, an initiator support, an initiator, energetic material, and a projectile body with a hollowed-out rear section.

To adapt the invention to existing projectiles, another embodiment of the invention additionally includes a rod adapter. The rod adapter is a short extension made of, for example, steel, with an integral pressure chamber (opening). The rod adapter includes threads on one end for attaching to existing inventoried domestic or foreign projectile rods and attaches to the fin at its other end.

In a third embodiment, the invention includes a fin, a projectile body with a hollowed-out rear section, electrically detonatable explosive bolts for attaching the fin to the projectile body and a safe and arm electronics circuit that detonates the explosive bolts.

The invention uses an electronic safe and arm circuit to sense launch and spin levels. Once armed, the stored energy from the electronic safe and arm circuit is dumped into an initiator or directly to explosive bolts. The initiator ignites an energetic material to separate the fin from the projectile in-flight at a predetermined time. Alternatively, the explosive bolts separate the fin from the projectile in-flight at a predetermined time. In the embodiments using an initiator and energetic material, an opening or cavity in the rear portion of the projectile body or rod adapter acts as a pressure chamber. When enough pressure has built up from the burning of the energetic material, the front hub of the fin section expands enough to disengage the threads and separates the fin section from the projectile body.

Figure 1:
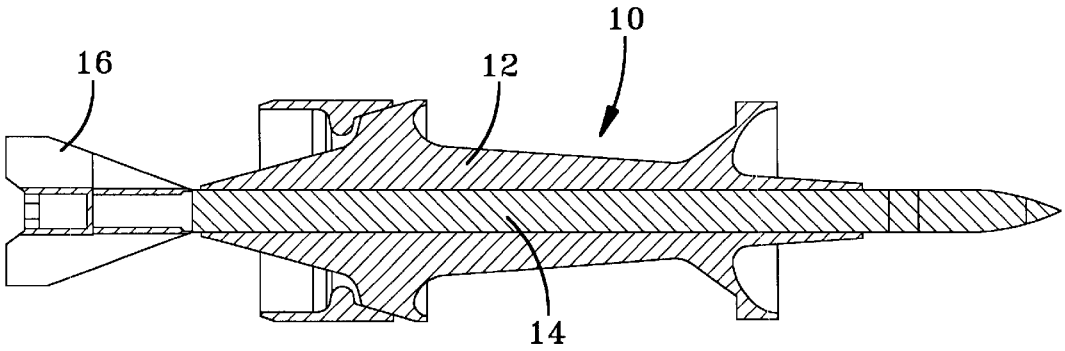
FIG. 1 is a cross-section of an exemplary projectile of the invention.

FIG. 1 is a cross-section of an exemplary projectile 10 of the invention. The projectile 10 is a sub-caliber fin-stabilized gun launched projectile. A sabot 12 is discarded after launch. The projectile 10 may be made of, for example, steel. Projectile 10 includes fin section 16 and body section 14. The invention includes a means for separating the fin section 16 from the body section 14 while the projectile 10 is in flight.

Figure 2:
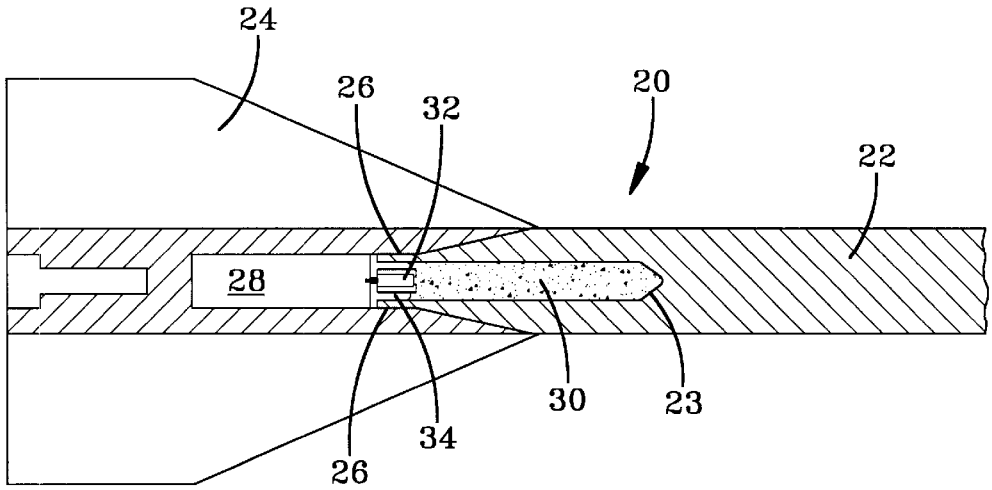
FIG. 2 is an enlarged view, partially in cross-section, of one embodiment of the invention.

FIG. 2 is an enlarged view, partially in cross-section, of one embodiment of a projectile 20 according to the invention. The rear portion of the body section 22 includes external threads. The fin section 24 includes internal threads and the rear portion of the body section 22 is attached to the fin section 24 by engagement of the external threads with the internal threads at 26.

The rear portion of the body section 22 includes a hollowed-out opening 23 formed therein. The means for separating the fin section 24 from the body section 22 includes a safe and arm circuit 28 disposed in the fin section 24, an initiator 32 connected to the safe and arm circuit 28 and disposed in the opening 23 in the rear portion of the body section 22, an initiator support 34 that contains the initiator 32, and energetic material 30 disposed in the opening 23 in the rear portion of the body section 22.

Figure 3A:
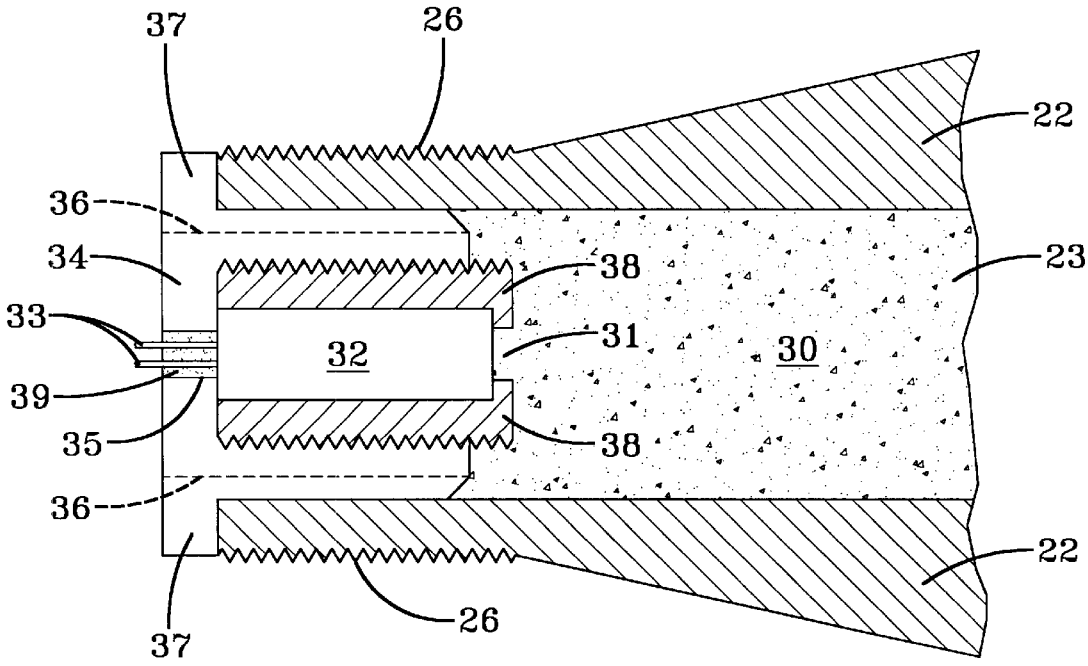
FIG. 3(A) is an enlarged view, partially in cross-section, of the initiator support of the embodiment of FIG. 2.
Figure 3B:
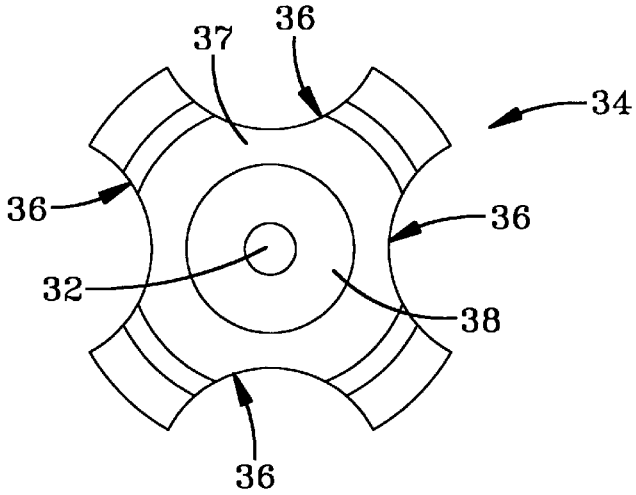
FIG. 3(B) is a view of the initiator support of FIG. 3(A), viewed from the right hand side of FIG. 3(A).

FIG. 3(A) is an enlarged view, partially in cross-section, of the initiator support 34 of the embodiment of FIG. 2. FIG. 3(B) is a view of the initiator support 34 of FIG. 3(A), viewed from the right hand side of FIG. 3(A). The initiator support 34 may be made of, for example, aluminum. The initiator support 34 comprises an outer portion 37 and an inner portion 38. The outer portion 37 includes a plurality of channels 36 formed in the exterior surface thereof. The channels 36 may be semi-circular in shape. Initiator 32 is disposed inside inner portion 38.

External threads on inner portion 38 engage internal threads on outer portion 37. Inner portion 38 surrounds initiator 32. Inner portion 38 includes opening 31 to allow the initiator 32 to ignite the energetic material 30. The initiator support 34 protects the initiator 32 from tank-level launch environments such as accelerations up to 60,000 g's and chamber pressures up to 50,000 psi. Outer portion 37 includes an opening 35 through which initiator leads 33 are routed. Initiator leads 33 are connected to safe and arm circuit 28. Opening 35 is filled with potting material 39 to protect initiator leads 33.

After projectile 20 is launched and armed, the safe and arm circuit 28 delivers its electrical charge at a predetermined time to the initiator 32 which ignites energetic material 30. Energetic material 30 produces high pressure gas that flows via channels 36 to the thread section 26 of the fin section 24 and the body section 22. The high pressure gas causes the fin section 24 to expand, thereby separating the fin section threads from the body section threads. The fin section 24 is disengaged from the body section 22, thereby limiting the range of the body section 22.

The electronic safe and arm circuit 28 safely arms the system when environmental conditions (for example, acceleration forces>18,000 g's and spin rate greater than 25 Hz) are met. Initiator 32 may be, for example, a semiconductor bridge initiator. Energetic material 30 may be, for example, Pyrodex propellant from Hodgdon's Powder Company. The energetic material 30 charge weight is matched to produce the desired failure mode of the fin threads (i.e., fracture, shear, or expansion of the fin hub) given the fin section's material properties, the propellant's ignition capabilities, and the geometry of opening 23. Without the fin section 24, the body section 22 becomes aerodynamically unstable and falls short of its predicted range.

Figure 4:
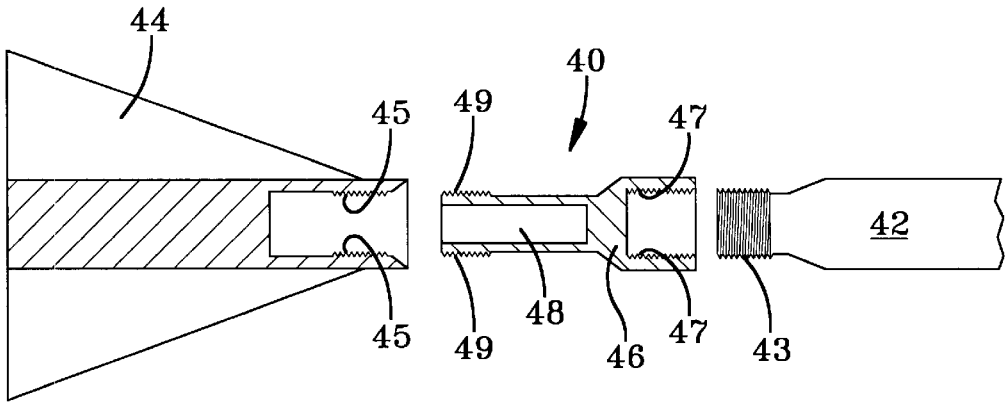
FIG. 4 is an exploded view, partially in cross-section, of a second embodiment of a projectile according to the invention.

FIG. 4 is an exploded view, partially in cross-section, of a second embodiment of a projectile 40 according to the invention. Projectile 40 is exemplary of an existing projectile that is retrofitted so that the fin section 44 will disengage from the body section 42 while projectile 40 is in-flight. A rod adapter 46 having internal threads 47 at one end is threadably engaged to the external threads 43 of the body section 42 of projectile 40. External threads 49 on the other end of rod adapter 46 are threadably engaged to the internal threads 45 of the fin section. Rod adapter 46 includes an opening 48 in a rear portion thereof.

The embodiment of FIG. 4 is similar to the embodiment of FIGS. 2 and 3 with the addition of the rod adapter 46 for connecting the fin section 44 to the body section 42. The opening 48 in the rod adapter 46 of FIG. 4 corresponds to the opening 23 in the body section 22 of FIGS. 2 and 3. In other respects, the two embodiments are the same (See FIGS. 2 and 3). Thus, in the embodiment of FIG. 4, the means for separating the fin section 44 from the body section 42 includes a safe and arm circuit 28 disposed in the fin section 44, an initiator 32 connected to the safe and arm circuit 28 and disposed in the opening 48 in the rear portion of the rod adapter 46, an initiator support 34 that contains the initiator 32, and energetic material 30 disposed in the opening 48 in the rear portion of the rod adapter 46.

The initiator support 34 includes a plurality of channels 36 formed on an exterior surface thereof such that gases produced by the energetic material 30 flow to the threads 45, 49 of the fin section 44 and the rod adapter 46. The safe and arm circuit 28, initiator 32, initiator support 34 and energetic material 30 function as described with reference to FIGS. 2 and 3.

Figure 5:
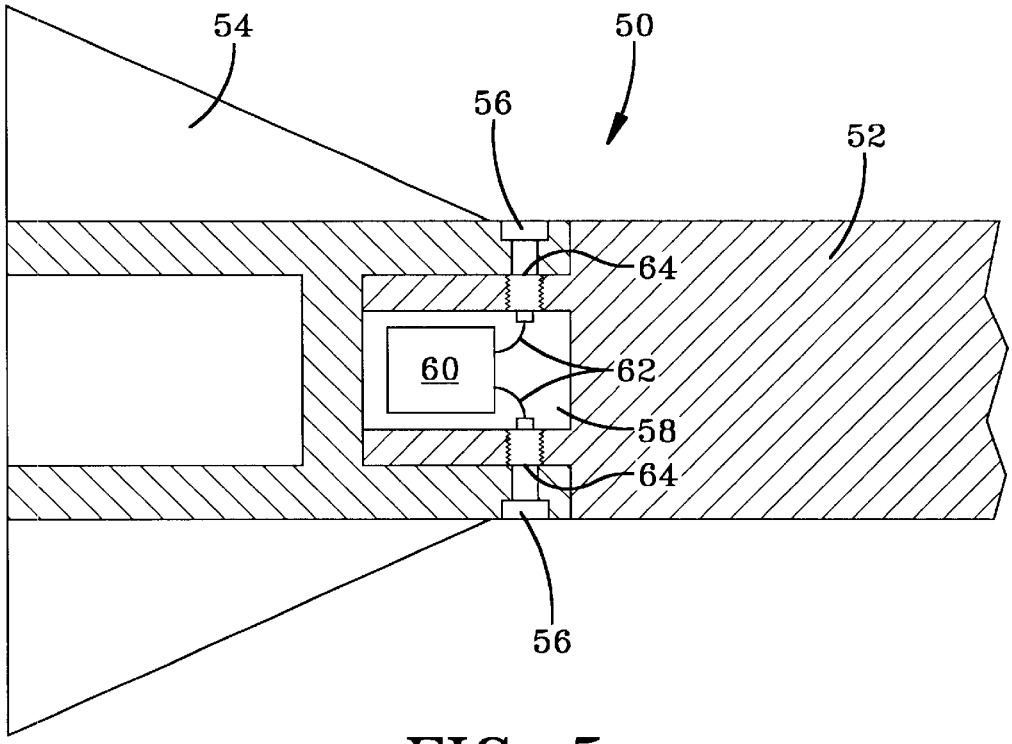
FIG. 5 is a partial cross-section of a third embodiment of a projectile 50 according to the invention.

FIG. 5 is a partial cross-section of a third embodiment of a projectile 50 according to the invention. Projectile 50 includes a fin section 54 and a body section 52. The rear portion of the body section 52 includes an opening 58 formed therein. The means for separating the fin section from the body section includes a plurality of electrically detonatable explosive bolts 56 that attach the fin section 54 to the rear portion of the body section 52. An electronic safe and arm circuit 60 is disposed in the opening 58 in the rear portion of the body section 52. The electronic safe and arm circuit 60 is electrically connected by wires 62 to ends of explosive bolts 56 for detonation thereof.

Electronic safe and arm circuit 60 functions as described previously. After arming and the predetermined time delay, circuit 60 delivers an electric charge through wires 62 to explosive bolts 56. The electric charge causes the explosive bolts 56 to detonate and fracture at point 64. Thus, the failure of the bolts 56 allows the fin section 54 to separate from body section 52. In a preferred embodiment, four explosive bolts 56 are used. Explosive bolts 56 are available from McCormick Selph, Inc.

While the invention has been described with reference to certain preferred embodiments, numerous changes, alterations and modifications to the described embodiments are possible without departing from the spirit and scope of the invention, as defined in the appended claims and equivalents thereof.

What is claimed is:

1. A projectile, comprising:

a body section having a rear portion with external threads formed thereon and with an opening formed therein;

a fin section having internal threads formed therein, wherein the rear portion of the body section is attached to the fin section by engagement of the external threads of the body section with the internal threads of the fin section; and means for separating the fin section from the body section while the projectile is in flight comprising a safe and arm circuit disposed in the fin section, an initiator support disposed in the opening in the rear portion of the body section, an initiator attached to the initiator support and connected to the safe and arm circuit, and energetic material disposed in the opening in the rear portion of the body section.

2. The projectile of claim 1 wherein the initiator support includes a plurality of channels formed on an exterior surface thereof such that gases produced by the energetic material flow to the threads of the fin section and the body section.

3. A projectile, comprising:

a body section having a rear portion with external threads formed thereon;

a fin section having internal threads formed therein; and means for separating the fin section from the body section while the projectile is in flight comprising:

a rod adapter having an opening formed in a rear portion of the rod adapter and having internal threads for connection with the external threads of the body section and external threads for connection with the internal threads of the fin section; and a safe and arm circuit disposed in the fin section, an initiator support disposed in the opening in the rear portion of the rod adapter, an initiator attached to the initiator support and connected to the safe and arm circuit, and energetic material disposed in the opening in the rear portion of the rod adapter.

4. The projectile of claim 3 wherein the initiator support includes a plurality of channels formed on an exterior surface thereof such that gases produced by the energetic material flow to the threads of the fin section and the rod adapter.

5. A projectile, comprising:

a body section having a rear portion with an opening formed therein;

a fin section attached to the rear portion of the body section; and means for separating the fin section from the body section while the projectile is in flight comprising a plurality of electrically detonatable explosive bolts that attach the fin section to the rear portion of the body section, and an electronic safe and arm circuit disposed in the opening in the rear portion of the body section, the electronic safe and arm circuit being electrically connected to the electrically detonatable explosive bolts for detonation thereof.

6. A projectile, comprising:

a body section having a rear portion with an opening formed therein;

a fin section connected to the body section; and means for separating the fin section from the body section while the projectile is in flight comprising a safe and arm circuit disposed in the fin section, an initiator support disposed in the opening in the rear portion of the body section, an initiator attached to the initiator support and connected to the safe and arm circuit, and energetic material disposed in the opening in the rear portion of the body section.

* * * * *